US006960725B2

(12) United States Patent
Zhengkai et al.

(10) Patent No.: US 6,960,725 B2
(45) Date of Patent: Nov. 1, 2005

(54) ELECTROLUMINESCENCE (EL) TUBE AND WIRE AND MANUFACTURING METHOD

(76) Inventors: Yin Zhengkai, No. 44-24, Nanjing Road, Huangshi City, Hubei Province (CN); Lu Zumi, Deke Co., Po Tang Xiang He Di Advanced High Technology Development Zone, Tiantai Country (CN)

( * ) Notice: Subject to any disclaimer, the term of this patent is extended or adjusted under 35 U.S.C. 154(b) by 0 days.

(21) Appl. No.: 10/664,675

(22) Filed: Sep. 18, 2003

(65) Prior Publication Data

US 2004/0144558 A1 Jul. 29, 2004

(30) Foreign Application Priority Data

Jan. 9, 2003 (CN) ..... 3118433 A

(51) Int. Cl.[7] ..... H01B 7/00; H01B 7/18

(52) U.S. Cl. ..... 174/102 R; 174/108

(58) Field of Search ..... 174/36, 110 R, 174/110 SR, 113 R, 120 R, 120 C, 120 AR, 120 SR, 121 R; 428/690, 691, 917; 313/504–509, 511–512

(56) References Cited

U.S. PATENT DOCUMENTS

| | | | | | |
|---|---|---|---|---|---|
| 3,052,812 | A | * | 9/1962 | Dow | 313/511 |
| 3,069,579 | A | * | 12/1962 | Berg et al. | 313/511 |
| 3,278,784 | A | * | 10/1966 | Masaharu | 313/511 |
| 4,841,259 | A | * | 6/1989 | Mayer | 333/17.2 |
| 5,468,914 | A | * | 11/1995 | Falciglia et al. | 174/112 |
| 5,485,355 | A | * | 1/1996 | Voskoboinik et al. | 362/84 |
| 5,753,381 | A | * | 5/1998 | Feldman et al. | 428/696 |
| 5,869,930 | A | * | 2/1999 | Baumberg et al. | 313/506 |
| 5,876,863 | A | * | 3/1999 | Feldman et al. | 428/690 |
| 5,922,996 | A | * | 7/1999 | Ryeczek | 174/112 |
| 6,074,071 | A | * | 6/2000 | Baumberg et al. | 362/101 |
| 6,736,674 | B2 | * | 5/2004 | Korte et al. | 439/578 |

* cited by examiner

*Primary Examiner*—William H. Mayo, III
(74) *Attorney, Agent, or Firm*—Charles E. Baxley

(57) ABSTRACT

An electroluminescent wire core having a flexible central electrode, a luminescent layer and a transparent, conductive layer. An outer surface of the central electrode is coated with the luminescent layer and the transparent, conductive layer respectively. In the transparent, conductive layer is disposed luminescent power which is covered by thermoplastic macromolecular polymer and synthetic resin.

1 Claim, 10 Drawing Sheets

ELECTROLUMINESCENCE (EL) TUBE AND WIRE AND MANUFACTURING METHOD

BACKGROUND OF THE INVENTION

1. Field of the Invention

The present invention relates to the field of luminescent source of electroluminescence (EL) powder, and more particularly to a flexible linear or tubular luminescent body and relevant manufacturing techniques.

2. Description of the Prior Arts

According to the conventional manufacturing method and structure of EL powder-based luminescent wire, the outer surface of a metal electro-conductive wire will be covered with a layer of insulating medium, which outer surface will be further covered with a mixture of luminescent powder and adhesive. Finally, the outer surface of this layer of mixture will be sprayed with another layer of transparent electrode made of metal. The adhesive in the layer of mixture will be volatilized and left with pores filled with air, which can reduce the field capacitance of luminescent source and form small black spots. For filling these pores, generally some special devices will be used to allow a transparent filling liquid to penetrate and fill into these pores through the layer of transparent electrode. In addition, for preventing filling liquid from leaking or volatilizing from pores, a layer of transparent material like silicon oil, which has a blocking effect, will be used to cover the outer surface of the transparent layer of electrode. Complicated structure and manufacturing techniques and difficulties for controlling the quality of penetration of filling liquid and the blocking effects of blocking layer, all these have made this kind of luminescent wire not only of high cost, but also with bad luminescent quality and effect.

SUMMARY OF THE INVENTION

The primary object of the present invention is to overcome the above-mention deficiencies of conventional manufacturing techniques and, by using the same materials and under the same conditions of conventional luminescent wire products, to provide a luminescent wire product with simple structure and manufacturing techniques, low cost, stable luminescent effect, and reliable quality.

This invention provides a kind of non-metal EL wire that is much flexible and with larger tensile strength and range of application compared with conventional metal luminescent wire.

This invention further provides a kind of metal or non-metal luminescent tube that is lighter, softer, and with larger luminescence area and lower cost compared with conventional columned luminescent body made of several luminescent wires running side-by-side.

The detailed solution of this invention concerns a linear central electrode of EL field made from metal or non-metal wire, a luminescent layer consisting of luminescent powder, transparent thermoplastic macromolecular compound or synthetic resin, which directly surrounds, covers, or being squeezed on the outer wall of linear central electrode, and then a transparent layer of electrode evenly is covered on the outer wall of linear luminescent layer, on the transparent layer of electrode is wrapped with an assistant electrode, and a layer of transparent compound is defined as the outmost layer.

Transparent thermoplastic compound or synthetic resin has good insulating and dielectric performance, and can form an insulating capsule outside the particles of luminescent powder when mixed with it. The luminescent layer made of this mixture can be directly covered or spread on central electrode, which process can omit the necessity of using insulating medium layer made of inorganic material, the barium titanate powder, and helps reducing manufacturing cost.

The manufacturing process of this invention concerns mostly this coating process of luminescent layer, which has two types depending on the functional macromolecular materials used for making the luminescent powder mixture.

(1) Luminescent layer is made of luminescent powder and insulating and dielectric transparent synthetic resin such as organic silicon resin, polyurethane, or epoxy resin. In this case, the luminescent layer should be extrusion-coated for multiple times using coating material made of luminescent powder with different concentration, synthetic resin compound, and relevant additional agents. The concentration of luminescent powder reduces after each time of coating. The thickness of each coating is about 10 um, and the luminescent powder of later coating can extrude and fill into the concave gaps formed during last coating process. After twice or more coating processes, the luminescent powder in luminescent layer forms a dense distribution, and the few pores left can be filled by macromolecular polyester resin or cross-linking substance of organic silicon resin after thermosetting or photofixing processes.

(2) The luminescent layer is made of luminescent powder and transparent thermoplastic macromolecular compound. The granulating process is completed by mixing luminescent powder and thermoplastic compound, which is transparent, insulating, and dielectric. The mixture is then coated directly on the wire of central electrode using plastic extruding machine. The thickness of coating is about 40 um.

The two types of luminescent layers made using the above-mentioned techniques are all insulating and dielectric in property. Not only can an even, bright, insulating and dielectric film be formed on the surface of coating, but also larger capacitance and brightness can be achieved.

This invention further provides a new structure and new technique that can help enlarging luminescent area of linear luminescent body. Generally, for enlarging the luminescent area of linear luminescent body, people usually need to increase the diameter of the solid core linear central electrode. However, with the increase of diameter of central electrode wire, the linear luminescent body usually shows a reduced flexibility and larger weight. On the other hand, the diameter of central electrode wire of linear luminescent body cannot be increased limitlessly. It is recommended the diameter not exceed 2 mm. Here we use a hollow wire as central electrode, i.e. using metal or non-metal conductive soft tube as the central electrode of linear luminescent body. The tubular luminescent body achieved not only has a double-sized luminescent area, but also is light-weighted and much flexible.

For increasing the flexibility of tubular luminescent body, the conductive soft tube can be made of metal soft tube, corrugated tube, single or double hook flexible sheath, flexible tube weaved using metal or non-metal fine wires, conductive plastic tube, conductive rubber tube, or flexible tube with metal coating.

The outer surface of tubular central electrode will be extrusion-coated with a luminescent layer made from a mixture of luminescent powder and transparent synthetic resin or transparent thermoplastic macromolecular compound. The outer surface of luminescent layer will be wrapped and coated with transparent electrode layer.

At least one fine metal wire, which serves as accessory electrode, will contact with transparent electrode in luminescent wire and transparent electrode layer of luminescent tube or on the full axial length of their outer surfaces. If two or more metal wires are used as accessory electrodes, they can be wound inside transparent electrode or on its outer surface in positive or negative spirals. The metal or non-metal weaved flexible tube, which forms the central electrode of the luminescent tube of this invention, can be wrapped inside or on the outer surface of the polymer flexible tube using plastic extruding machine, and luminescent layer and transparent electrode layer will be coated layer by layer.

The luminescent powder used in the luminescent layer of this invention can be made by mixing inorganic luminescent materials such as zinc sulphide and copper powder, or organic macromolecular luminescent materials with higher brightness such as poly-alkylthrophene, para-phenylethyne, or poly-alkylfluorene etc.

The luminescent wire and tube products of this invention are light-weighted, flexible, with large luminescent area, tensile strength, and simple manufacturing process allowing consecutive industrial production, and can be applied extensively in decoration, advertisement, craftwork weaving and other areas.

DETAILED DESCRIPTION OF THE PREFERRED EMBODIMENTS

Figure 1:
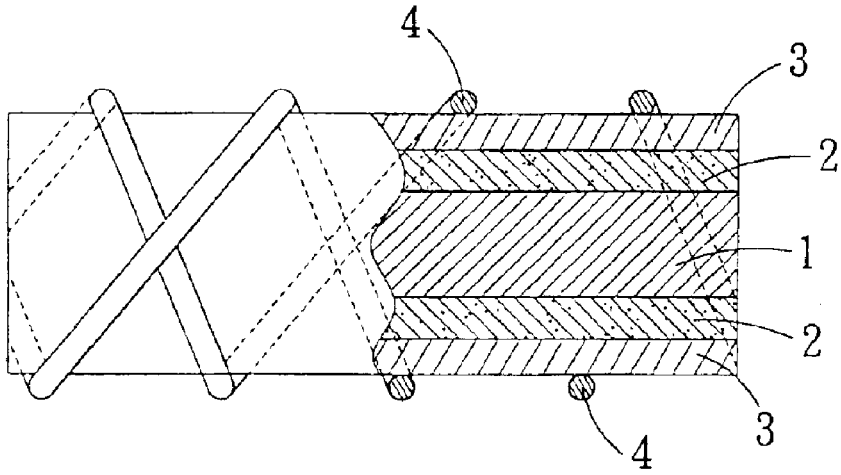
FIG. 1 is a cross-sectional view in axial direction of core body of luminescent wire using conductive wire as central electrode
Figure 2:
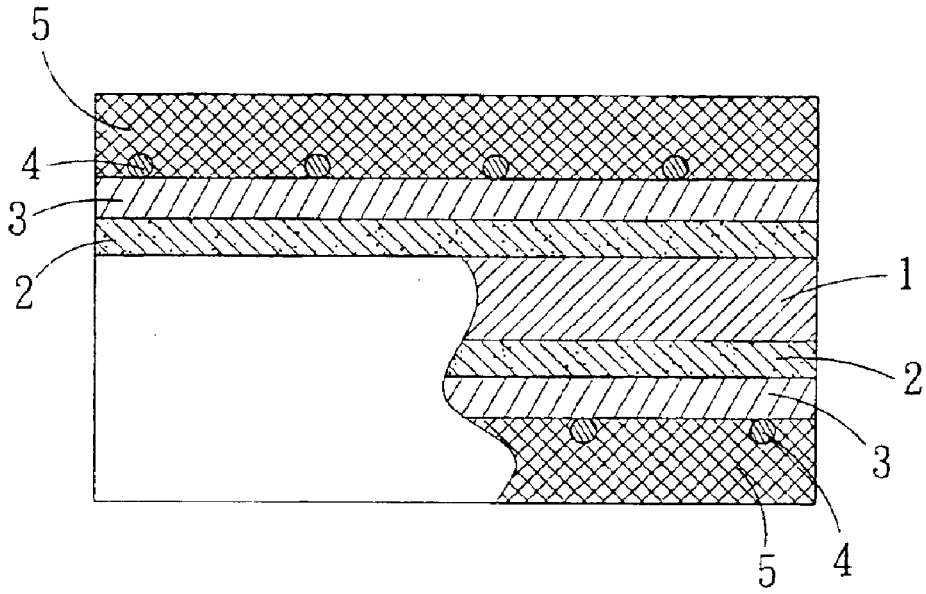
FIG. 2 is a cross-sectional view in axial direction of linear luminescent body using conductive wire as central electrode

Referring to FIG. 1, wherein a core of luminescent body has a central electrode made of metal or non-metal wire 1. A luminescent layer 2 consisted of a mixture of luminescent powder 6 and transparent macromolecular polymer, or polyurethane resin, or organic silicon resin 7, is coated on the outer surface of the central electrode. On the circular surface of luminescent layer 2, there is a transparent electrode layer 3 and an accessory electrode 4 wound on it. With reference to FIG. 2, wherein on the core of luminescent wire shown in FIG. 1, a layer of transparent polymers 5 made from PVC, EVA, or others, is coated to form a linear luminescent body.

Figure 3:
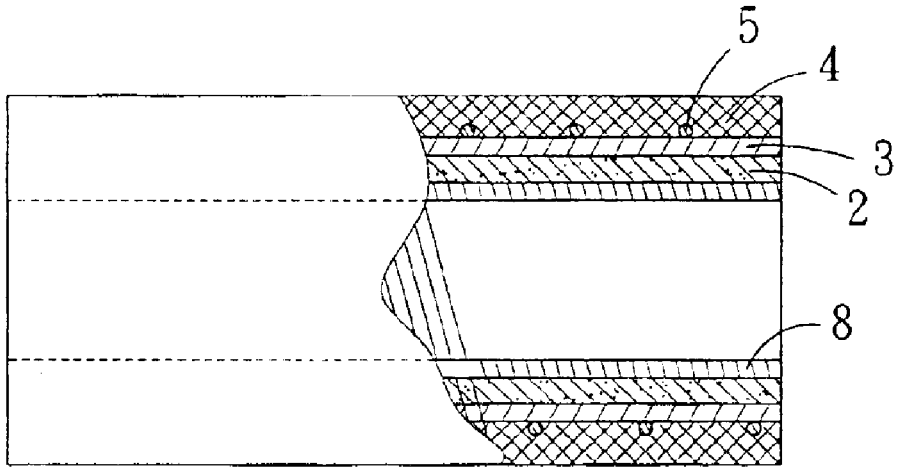
FIG. 3 is a cross-sectional view in axial direction of linear luminescent body using conductive flexible tube as central electrode

Besides metal or non-metal wire 1, metal or non-metal flexible tube 8 can also be used as central electrode See in FIG. 3.

As shown in FIG. 1, the winding structure of accessory electrodes used in this embodiment includes at least two accessory electrodes 4, which are wound on the axial outer surface of the transparent layer of linear luminescent body in positive and negative spirals. This winding scheme can ensure the good conductivity of accessory electrodes even if one of them is broken.

Figure 4:
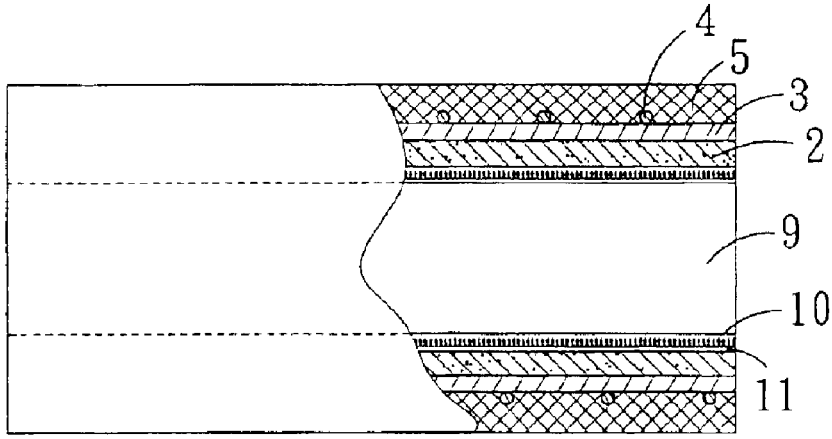
FIG. 4 is a cross-sectional view in axial direction of linear luminescent body using conductive weaved tube as central electrode

Referring to FIG. 4, wherein a conductive flexible tube weaved by metal or non-metal wires 10 is used as central electrode. This weaved tube can be coated with luminescent layer 2 and transparent electrode layer 3 successively to form luminescent tube, or by using plastic extrusion machine, be coated with polymer 11 to form polymer weaved tube. The outer surface of this weaved tube is then coated with luminescent layer 2, transparent electrode layer 3, accessory electrode 4, and transparent polymer layer 5 successively.

Figure 5:
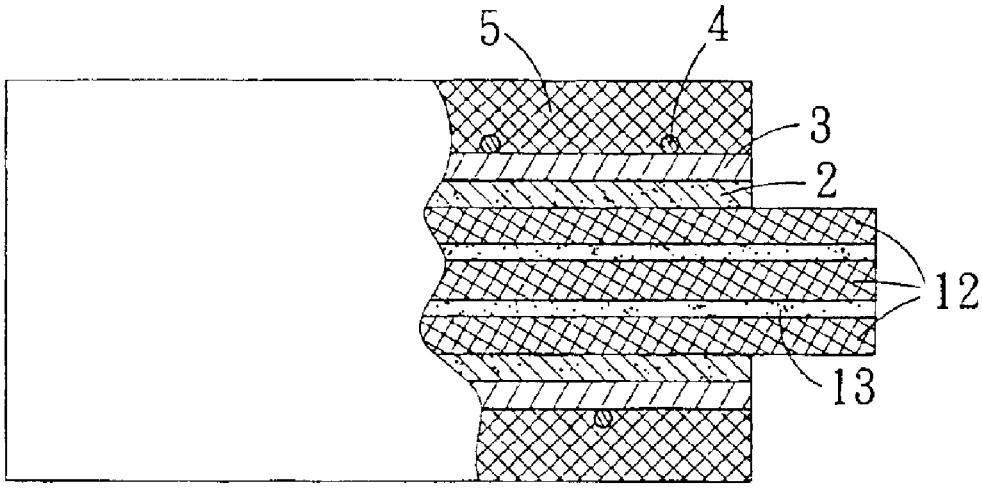
FIG. 5 is a cross-sectional view in axial direction of linear luminescent body using several parallel or twisted non-metal conductive wires as central electrode

Referring to FIG. 5, wherein a central electrode is made from several parallel or twisted non-metal conductive wires 12. The non-metal conductive wires are adhered together with using conductive adhesive 13 to enhance the conductivity of central electrode. On the outer surface of the central electrode 12, luminescent layer 2, transparent electrode layer 3, accessory electrode 4, and transparent polymer layer 5, are coated successively to form luminescent wire with non-metal central electrode.

The manufacturing process of linear luminescent body described in FIG. 1 is as follows:

(1) Mixing zinc sulfide with copper powder with granularity less than 20 um to form luminescent material 6, which is then mixed with transparent polyvinyl chloride 7 according to the weight ratio of 50~65%: 50~35% for granulation.

(2) Putting the granules formed in step 1 into plastic extrusion machine, and be heated to 140~175° C. for plasticizing. After this, they will be extruded out on the outer surface of central electrode to form a coating with about 40 um thickness. The coating will then be cooled by air or water to form a smooth and dense luminescent layer 2.

(3) Coating or covering the outer surface of luminescent layer 2 with a layer of transparent electrode 3, which outer surface will be wound with accessory electrode 4.

(4) Coating a layer of transparent polymer 5 such as PVC or EVA etc. on the outmost surface.

Instead of using transparent polyvinyl chloride in step 1 above-mentioned, terephthalate, polystyrene, polypropylene, polysulfone, or polycarbonate can also be used to achieve the luminescent layer 2 with the same luminescent effect.

Another manufacturing process mentioned in Application 1 is to be described as follows:

(1) Mixing luminescent powder with synthetic resin to form luminescent layer. For example, make luminescent podwer mixture by mixing luminescent powder with polyurethane transparent, insulating, dielectric, with viscosity of 10~150 Pas according to the weight ratio of 45~70%:55~30%, and add some proper additives such as hardener, plasticizer, antioxidant, and thinner etc. Reduce the concentration of luminescent powder to make several different mixtures, which will be put into several coating machines and agitated continuously. The granularity of luminescent powder in each coating machine varies from each other and reduces in order.

Figure 6:
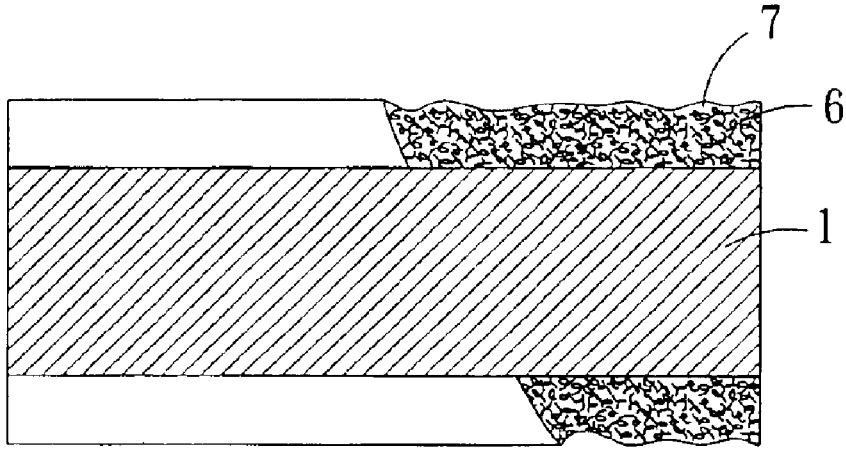
FIG. 6 is an amplified cross-sectional view in axial direction of central electrode after the first time coating with the mixture of luminescent powder and polyurethane resin or organic silicon resin.
Figure 7:
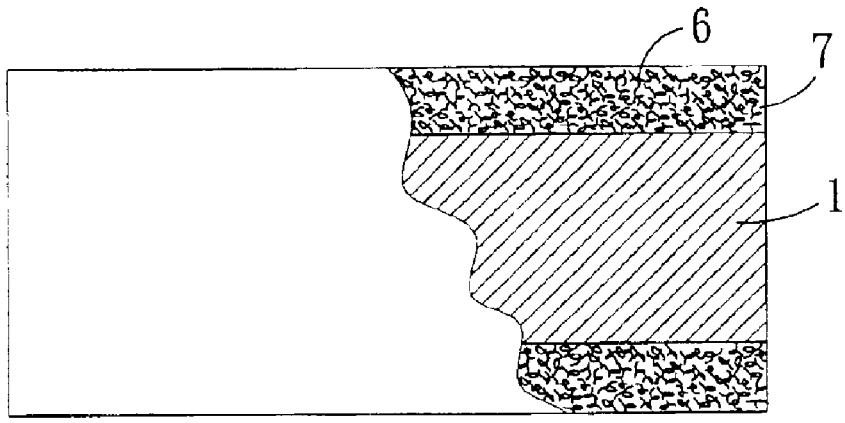
FIG. 7 is an amplified cross-sectional view in axial direction of central electrode after twice or more extrusion-coating with the mixture of luminescent powder and polyurethane resin or organic silicon resin
Figure 8:
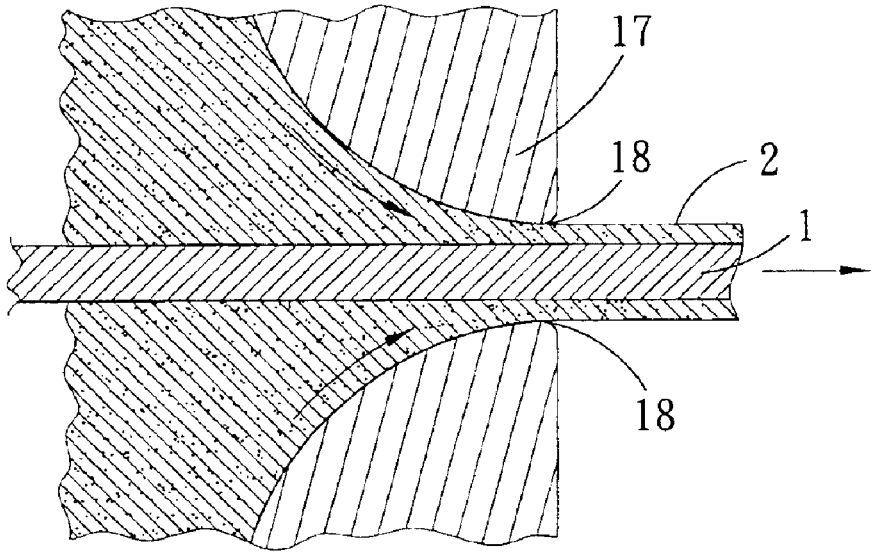
FIG. 8 is coating method of application 5

(2) As shown in FIG. 8, when central electrode wire 1 or conductive tube 8 is passing through the die orifice 17 of coating machine filled with the mixture of luminescent powder and resin in high speed, naturally a negative pressure will be formed in the small gap between the outer surface of central electrode and the die orifice 17. This negative pressure will force the mixture of luminescent powder and synthetic resin to move into the die orifice. As a result, the mixture of luminescent powder and polyurethane or organic silicon resin will be extruded out and coated on the outer surface of central electrode 1 or 8 to form the luminescent layer 2. After drying, the wire will be conveyed to next coating machine. The thickness of each coating is about 10 um. After several times of coating, a luminescent layer with smooth surface will be formed. See FIG. 6 and FIG. 7 for details. FIG. 6 is an enlarged view of cross-section in axial direction of central electrode 1, which outer surface is coated with a mixture of luminescent powder 6 and polyurethane or organic silicon resin. It is able to see that the granules of luminescent powder 6 show a loose distribution and the outer surface is coarse. FIG. 7 is the enlarged view of cross-section in axial direction of central electrode after twice or more coating processes using the above-mentioned mixture of luminescent powder and resin. The granules are densely distributed and the outer surface is smooth and even.

(3) After drying at the temperature of 120~155° C. for 60~300 seconds, gaps between granules of luminescent are filled with transparent, insulating, and dielectric cross-linking materials produced by solidified resin.

(4) Coating or covering the outer surface of luminescent layer 2 with a layer of transparent electrode 3, which outer surface will be wound with accessory electrode 4.

(5) Coating a layer of transparent polymer such as PVC or EVA etc. on the outmost layer.

Epoxy resin, acrylic resin, polyamide-imide resin, or polyester resin can also be used as substitutes of synthetic resin used in step 2. Luminescent layer with same luminescent effect can be achieved using these resins and proper additives according to above-mentioned manufacturing process. The luminescent layer with this kind of structure, with capacitance and light loss greatly reduced in the alternating electric field between central electrode 1 and transparent electrode 3, shows great luminescent effect.

Figure 9:
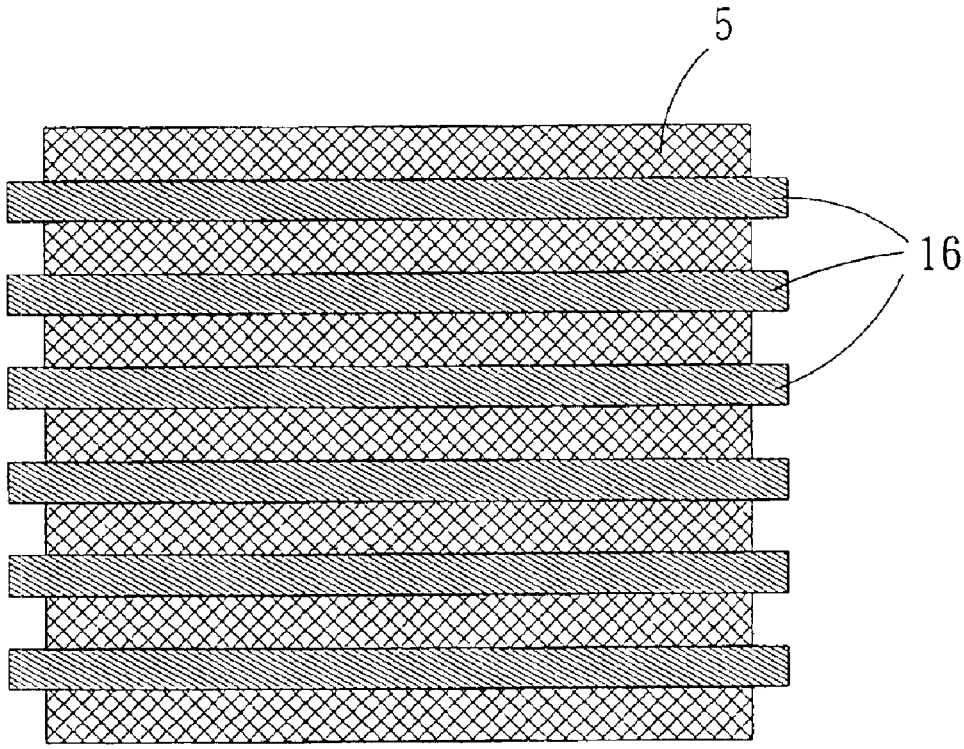
FIG. 9 is longitudinal cross-sectional view of row-type luminescent body

Referring to FIG. 9, which shows the structure of luminescent body produced by passing several luminescent cores 16 with structure shown in FIG. 1 through plastic extrusion machine.

Figure 10:
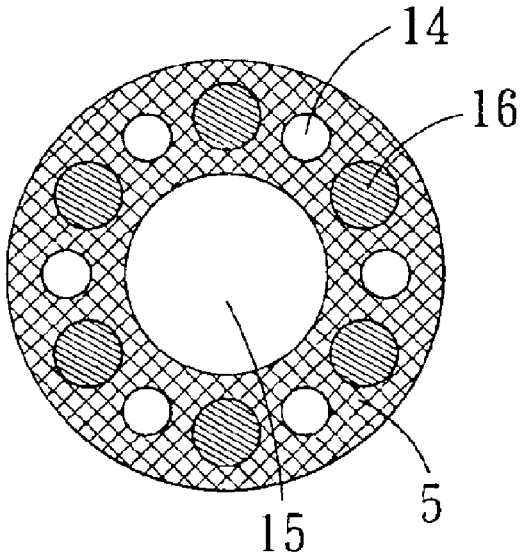
FIG. 10 is a radial cross-sectional view of columnar luminescent body.

Referring to FIG. 10, which shows a luminescent body with another type of structure. It contains several luminescent cores 16 with structure shown in FIG. 1. It's like a lotus root with a central through hole 15, and several through holes 14 and luminescent cores distributed around the central hole. This tubular luminescent body has a lighter weight and asks for less polymer material for manufacturing.

What is claimed is:

1. An electroluminescence wire core comprising a flexible central electrode, luminescent layer, and a transparent and conductive layer, the outer surface of central electrode being coated with the luminescent layer and the transparent and conductive layer, respectively, wherein:

in the transparent and conductive layer are disposed luminescent powder which is covered by thermoplastic macromolecular polymer and synthetic resin, the thermoplastic macromolecular polymer and the synthetic resin are transparent, insulating, and dielectric, at least two fine conductive wires wind around the transparent and conductive layer; and the thermoplastic macromolecular polymer includes polyvinyl chloride, polyethylene terephthalate, polypropylene, polystyrene, polysulfone, and polycarbonate, the synthetic resin includes organic silicon resin, polyurethane, polyester resin, acrylic resin, and epoxy resin;

the luminescent powder in the luminescent layer is made from a mixture of copper and zinc sulfide and organic substances including poly-alkylthrophene, para-phenylethyne, and poly-alkylfluorene;

the central electrode involves single non-metal wire, multiple non-metals wires which are adhered together using conductive adhesive, conductive flexible tube and weaved tube made from metal and non-metal material.

* * * * *